US006918631B2

(12) United States Patent
Verbovszky

(10) Patent No.: US 6,918,631 B2
(45) Date of Patent: Jul. 19, 2005

(54) CHILD'S CAR SEAT CUSHION

(76) Inventor: Esther A. L. Verbovszky, 325 N. Falmouth Dr., Rocky River, OH (US) 44116-1326

( * ) Notice: Subject to any disclaimer, the term of this patent is extended or adjusted under 35 U.S.C. 154(b) by 0 days.

(21) Appl. No.: 10/677,028

(22) Filed: Sep. 29, 2003

(65) Prior Publication Data

US 2004/0155515 A1 Aug. 12, 2004

Related U.S. Application Data

(63) Continuation-in-part of application No. 10/360,496, filed on Feb. 6, 2003.

(51) Int. Cl.[7] ..... A47C 7/36; A47C 31/11

(52) U.S. Cl. ..... 297/219.12; 297/393; 297/397

(58) Field of Search ..... 297/487, 488, 297/392, 393, 397, 219.12, 220

(56) References Cited

U.S. PATENT DOCUMENTS 4,776,049 A * 10/1988 Perron ..... 297/393 X
5,586,351 A * 12/1996 Ive ..... 297/219.12 X
5,826,287 A * 10/1998 Tandrup ..... 297/219.12 X
5,916,089 A 6/1999 Ive ..... 297/219.12
6,036,263 A 3/2000 Gold ..... 297/219.12
6,467,840 B1 * 10/2002 Verbovszky et al. ... 297/219.12

* cited by examiner

*Primary Examiner*—Rodney B. White
(74) *Attorney, Agent, or Firm*—Tarolli, Sundheim, Covell & Tummino L.L.P.

(57) ABSTRACT

A method of helping to secure an infant in a child's car seat and to prevent slouching of the infant in the car seat includes the step of placing a cushion having a unitary tube shaped structure into the car seat and placing an infant into the car seat where the tube-shaped structure has an upside-down U-shape including two legs with two axial ends and a base portion where the two legs are joined together. The base portion is located at the top of the back surface of the car seat and the two axial ends of the legs are located at the free edge of the seat surface of the car seat. The cushion legs engage the side walls of the car seat. The method includes the step of placing the infant into the car seat so that the infant is surrounded by the cushion base portion and legs to reduce the surface area of the car seat for the infant to occupy in order to help to minimize slouching of the infant in the car seat.

11 Claims, 8 Drawing Sheets

CHILD'S CAR SEAT CUSHION

This application is a continuation-in-part of copending application(s) application Ser. No. 10/360,496 filed on Feb. 6, 2003,

TECHNICAL FIELD

The present invention relates, generally, to a method of protecting a child in a car seat and, to cushions for children's car seats to provide improved support and security for the child, especially for infants and newborns.

BACKGROUND OF THE INVENTION

Many states have laws requiring that children be restrained in a car seat while in an operating vehicle. Child car seat manufacturers have developed two different standard types and sizes of car seats to assure parents that not only are their children safe but, that they are compliant with the state laws. The first standard type car seat is the infant carrier which is typically used with infants who weigh up to 20 pounds. The second standard type car seat is the front facing toddler support which is for toddlers who weigh from 20 pounds to 50 pounds. Unfortunately, the toddler support car seat due to its larger dimensions cannot accommodate newborns or very small infants, including premature infants and prematurely discharged newborns. The infant carrier, which is smaller than the toddler support, is also often too large to accommodate newborn or premature infants.

Infants who are too small to properly fit in a car seat can flop back and forth while in the car seat. Newborn or prematurely born infants, when placed into a car seat, are commonly forced into a seated orientation in which either the head is slumped or slouched or their entire bodies are slouched over since their bodies are not large enough to cover the surface area of the car seat. This not only affects the comfort of the child but also his or her safety and health.

Much of the surface area of the car seat between the body of the infant and the side walls of the car seat is left unoccupied. Even when the infant is secured by the safety belt which is part of the car seat structure, the infant is not supported at its lateral sides of its body and at its head and neck by the seat belt. The safety of the infant may be compromised in this situation.

Moreover, infants can be uncomfortable in such a slumped or slouched over orientation. A slumped or slouched over orientation can negatively affect the infant's breathing. Studies have shown that premature infants have significant decreases in oxygen saturation while restrained in a car seat with 30% experiencing hypoxia, bradycardia, sleep apnea or some combination of those conditions.

The decrease in oxygen saturation is directly related to the degree to which the infant is slumped or slouched over in the car seat; the more slumped or slouched over is the infant, the greater the physiological risk, the less slumped or slouched over is the infant, the lesser the physiological risk. This occurs because the more slumped or slouched over the infant is, either forward or sideways, the greater the risk of airway obstruction in the infant.

Infant slouching or slumping occurs for two basic reasons, low birth weight infants cannot resist the gravitational effects if their bodies are in a too upright position, and standard sized child car seats do not provide the necessary support and orientation for these infants to prevent the gravitational effects. These effects can cause slouching or slumping since most infants do not have the physical maturation or strength of the back to maintain an upright position.

Accordingly, there exists a need for a child's car seat cushion that helps to support the child in a physiologically and physically beneficial orientation when the child is too small for the car seat by minimizing or preventing the child from slouching or slumping. There also exists a need for a child's car seat cushion that helps to secure the child who is too small to fit in standard size car seats in such car seats in order to help protect the child from injury during a vehicle crash event or sudden vehicle movement.

SUMMARY OF THE INVENTION

The present invention provides a child's car seat cushion that satisfies the aforementioned needs. Accordingly, it is an object of the present invention to provide a cushion that inserts into any standard child's car seat.

It is another object of the present invention to provide a cushion that will support and help to secure a child, but especially newborns and infants while in a car seat.

It is yet another object of the present invention to provide a car seat cushion that supports the child on the lateral sides of the child's body such that the child is properly positioned and secured while in the car seat and the space between the child's body and head and the side walls of the car seat is reduced to a minimum or eliminated altogether to prevent slumping over or slouching over of the child while in the car seat.

It is yet another object of the present invention to provide a car seat cushion that is manufactured from cushioning media to provide comfort, support and security to the child while in the car seat.

Accordingly, the present invention relates to a child's car seat cushion placed into a car seat to secure a child who is too small for the car seat in a comfortable orientation and which also helps to protect the child from injury and helps to prevent airway obstruction due to a slumped or slouched over orientation.

A method of helping to secure an infant in a child's car seat and to prevent slouching of the infant in the car seat includes the step of placing a cushion having a unitary tube shaped structure into the car seat and placing an infant into the car seat where the tube-shaped structure has a U-shape including two legs with two axial ends and a base portion where the two legs are joined together. The base portion is located at the top of the back surface of the car seat and the two axial ends of the legs are located at the free edge of the seat surface of the car seat. The cushion legs engage the side walls of the car seat. The infant is placed into the car seat so that the infant is surrounded and engages the cushion base portion and legs to reduce the surface area of the car seat for the infant to occupy in order to help secure the infant in the car seat and to prevent slouching of the infant in the car seat.

BRIEF DESCRIPTION OF THE DRAWINGS

The foregoing and other features of the present invention will become apparent to those skilled in the art to which the present invention relates upon reading the following description with reference to the accompanying drawings, in which.

DETAILED DESCRIPTION OF THE INVENTION

Figure 1:
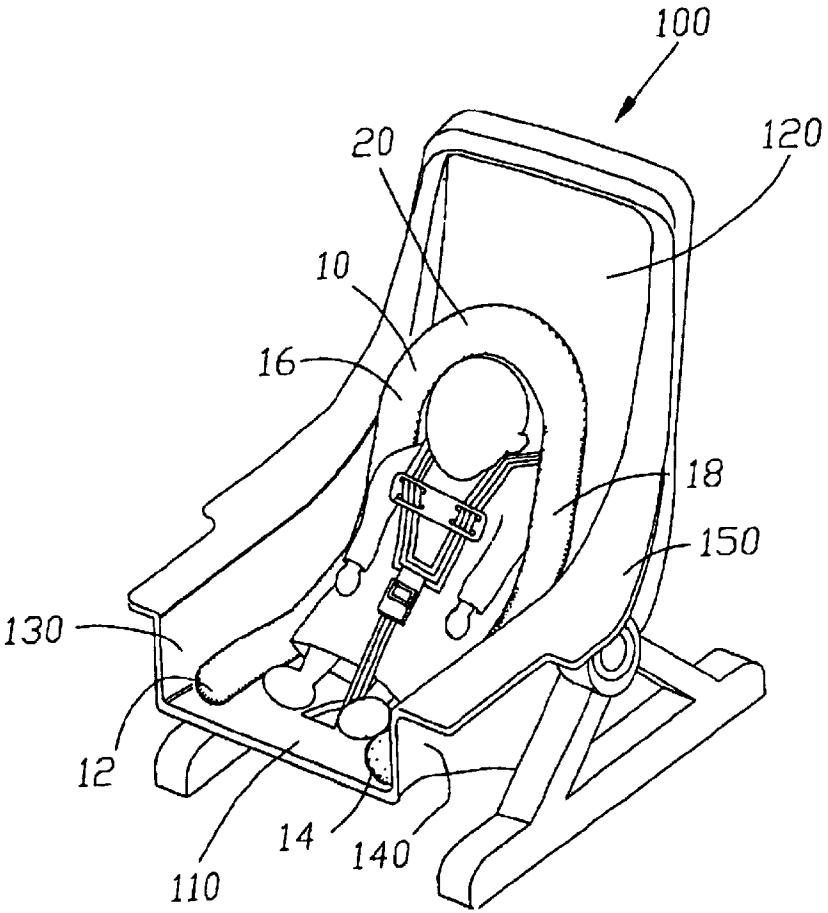
FIG. 1 is a perspective view of a child's car seat with a cushion according to the present invention shown inserted in a child's car seat with an infant.

The present invention is a child's car seat cushion 10 shown in FIG. 1 placed in a car seat 100 with an infant. The cushion 10 helps to secure and support the infant who does not fit into standard sized car seats. The car seat 100 is illustrated in a schematic view and can have any similar construction. The car seat 100 includes a seat surface 110 and a back surface 120 extending upwardly from the edge of the seat surface 100. The car seat 100 also includes two lateral side walls 130, 140 between which the seat surface 110 and the back surface 120 extend.

Figure 2:
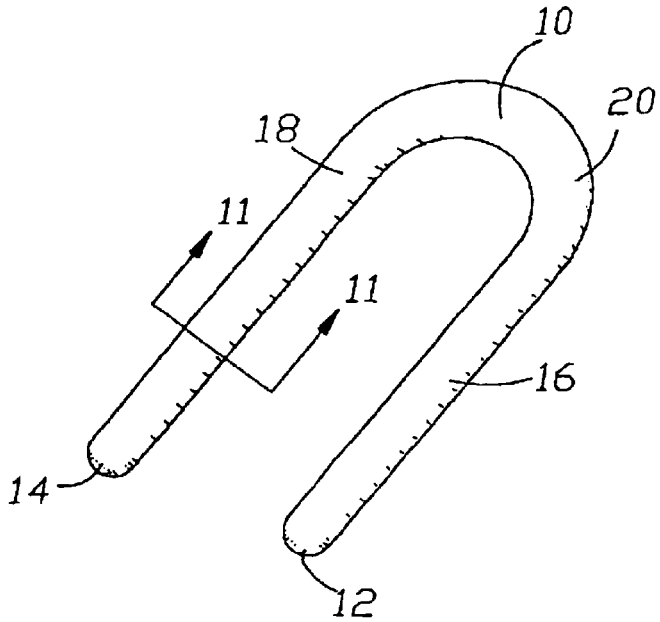
FIG. 2 is a perspective view of the child's car seat cushion according to the present invention shown in FIG. 1.

The cushion 10 is an elongate flexible, unitary tube-shaped structure with two axial ends 12, 14. (FIG. 9) For insertion into the car seat 100, the cushion 10 is manually bent at approximately the middle of its length to form an upside down "U" shape. (FIG. 2) The upside down U-shaped cushion 10 has two legs 16, 18 extending an approximately equal distance. The two legs 16, 18 extend from a base portion 20 where the two legs are joined together.

The cushion 10 is placed onto the car seat 100 (FIG. 1) adjacent the seat surface 110 and back surface 120 of the car seat so the base portion 20 of the cushion 10 is located at the top of the back surface of the car seat above the infant's head. The two axial ends 12, 14 of the upside down U-shaped cushion 10 are located at the free edge of the seat surface 110 of the car seat 100 where the infant's legs and/or feet are located when the infant is seated in the car seat.

The two legs 16, 18 of the cushion 10 are pushed into a recess 150 formed at the intersection of the seat surface 110 and back surface 120 of the car seat 100. The infant is located in the car seat 100 so that the head of the infant contacts and is surrounded by the base portion 20 of the cushion 10 and the entire lateral sides of the body of the infant contact the two legs 16, 18 of the cushion. The cushion 10 conforms to the body shape of the infant.

Figure 11:
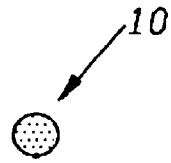
FIG. 11 is a cross-sectional view of the child's car seat cushion taken along section line 11—11 in FIG. 2.

The cushion 10 is preferably made of a tube of French terry cloth material filled with batting. (FIG. 11.) French terry cloth material consists of 80% cotton/20% polyester fiber. The batting is preferably a flame retardant 100% polyester material. Instead of French terry cloth, the material of the cushion 10 may be any suitable equivalent textile material such as cotton, polyester, wool, fleece, or a combination thereof. Instead of batting, the cushion 10 can be filled with foam or gel or other suitable material or can be inflated with water or air in a vinyl casing and covered with a textile material. Also, the batting may be of a suitable material other than polyester materials.

The cushion 10 is sewn together lengthwise along a seam 22. The seam 22 is preferably located on the underside of the cushion 10 when placed in the car seat 100. Instead of sewing, the material can be joined together by for example, a zipper, snaps, buttons, gluing or by a Velcro™ type hook-and-eye closure.

The material of the cushion 10 may alternately be made of a cushioning media such as a flame retardant foam rubber or foam vinyl covered with a suitable washable skin made of hypoallergenic plastic, nylon, polyurethane or any suitable material. The cushioning media may have skin manufactured with a nylon facing and a backing of a 65%/35% combination of polyester and cotton. The foam used in the manufacture of the cushion can also be a particular type of foam known as "memory foam". Memory foam temporarily retains the shape of an object which is pressed onto it. For example, memory foam can temporarily retain the body shape of an infant who is placed on the foam. The cushion 10 is washable. The cushion 10 reduces the surface area of the seat surface 110 and back surface 120 on the car seat 100 on which the infant is placed and provides an additional wall of cushion material.

Figure 10:
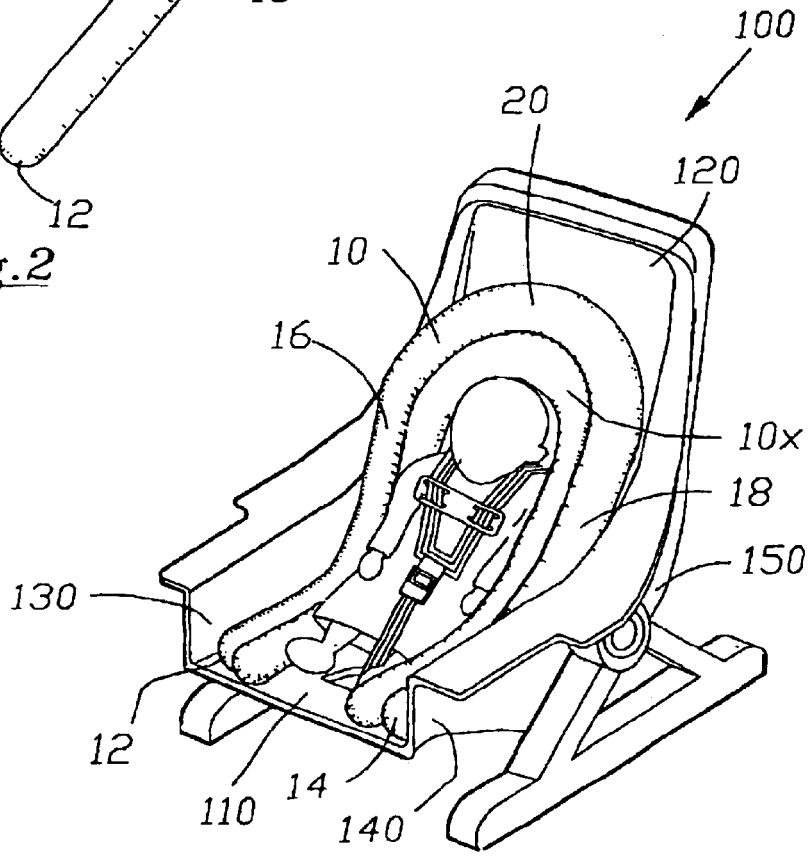
FIG. 10 is a view identical to FIG. 1 except two child's car seat cushions according to FIG. 2 are shown inserted side by side in a child's car seat with an infant.
Figure 7:
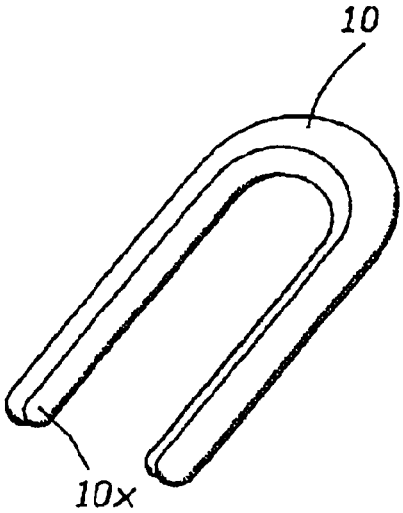
FIG. 7 is a view of two child's car seat cushions according to FIG. 2 placed side by side.

As can be seen in FIGS. 7 and 10, a second cushion 10*x* can also be placed in the car seat 100 on the inside of the cushion 10. The second cushion 10*x* is identical to the cushion 10 except that the second cushion 10*x* is smaller in thickness and in length than the cushion 10. The second cushion lox can also be the same size as the cushion 10. The second cushion 10*x* is be placed side by side next to the cushion 10 in the car seat 100 when the infant is very small in size, for example, when the infant is a new born or a premature infant and does not properly fit into the car seat 100. Similarly, when the infant grows to a larger size, the second cushion 10*x* is removed from the car seat, leaving only the cushion 10 which increases the surface area of the car seat upon which the infant can lie.

Figure 9:
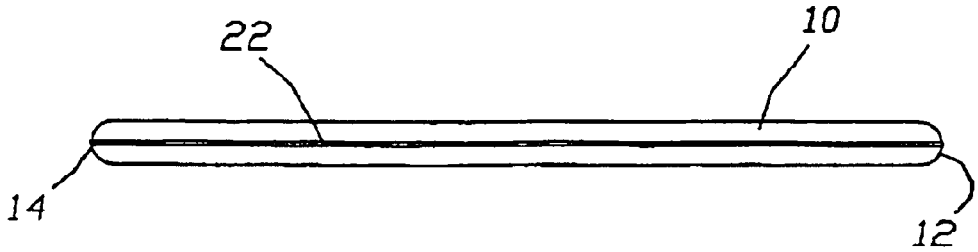
FIG. 9 is a view of the child's car'seat cushion according to FIG. 2 in an elongated condition.

In the embodiment according to FIG. 9, the cushion 10 is approximately 56 inches in length. The diameter of a cross-section of the cushion 10 is approximately 4 inches. (FIG. 11) It is to be understood that the cushion 10 can have various dimensions according to the desire of the manufacturer. For example, the cushion 10 can range in diameter from approximately 1–6 inches. Also, the length of the cushion 10 can range from approximately 40–90 inches.

In another embodiment of the cushion 10, the cushion 10 is detachable from itself and separated into two pieces at the midpoint of its length by a Velcro™ type hook-and-eye closure or other releasable closure.

Figure 3:
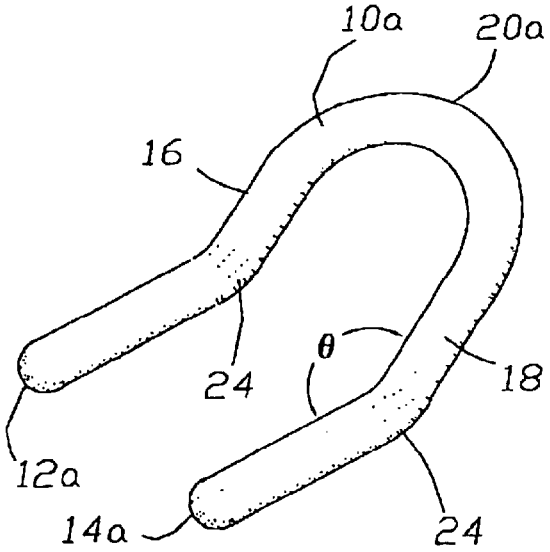
FIG. 3 is a perspective view of a second embodiment of the child's car seat cushion according to the present invention.

FIG. 3 illustrates a second embodiment of the invention. The cushion 10*a* is similar to the cushion 10 shown in FIGS. 1–2, and parts that are the same or similar are given the same reference numerals with the suffix "a" attached. In this embodiment, the cushion 10*a* is pre-formed into an upside down U-shape and includes an pre-formed elbow shaped bend 24 in each of the legs 16*a,* 18*a* at a location which is at approximately half of the length of the legs. The pre-formed angle θ of the bend is approximately 105° before insertion into the car seat 100. 105° is approximately equal to the standard cradle angle formed by the intersection of the seat surface 110 and back surface 120 of the car seat 100. (FIG. 1). In another embodiment of the cushion 10*a* (not shown), each of the legs of the cushion 10*a* has a reduced thickness/diameter relative to the thickness/diameter of the remainder of the cushion. The reduced thickness portions of the cushion are located relative to the child along a distance approximately between the child's temples and chin. The reduced thickness portions allow for a larger empty space between the child's temples and chin and the cushion 10*a* in order to help the child to breathe easier if, for example, the child turns its head in the left or right directions. The top of the child's head is in contact with the base of the cushion 10*a* to provide support to the child's head to help the child's head to face in a forward direction. Similar to the cushion 10, cushion 10*a* contacts the entire lateral sides of the infant and conforms to the shape of the infant.

Although the cushion 10*a* is pre-formed, the cushion is also flexible. The cushion 10*a* is pre-formed by cutting out a fabric pattern which includes the shape of the bend 24, sewing the fabric together and stuffing the cushion with batting.

Although the cushion 10*a* is not shown placed into a car seat, the placement of cushion 10*a* is similar to the placement of the cushion 10 according to FIG. 1. When the cushion 10*a* (FIG. 3) is placed in the car seat 100, the location of the elbow shaped bend 24 is aligned over the recess 150 in the car seat. The cushion 10*a* conforms to the contours of the car seat 100 and the bend angle θ conforms to the standard cradle angle of the car seat.

The pre-formed upside down U-shaped cushion 10*a* with elbow bend 24 eliminates the steps of bending the cushion into an upside-down U-shape before insertion into the car seat 100 and eliminates the step of pushing the legs 16*a,* 18*a* into the recess 150 formed at the intersection of the seat surface 110 and back surface 120 of the car seat.

Figure 8:
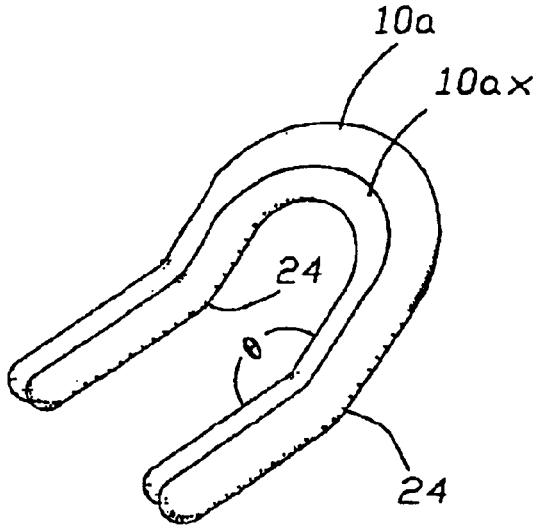
FIG. 8 is a view of two child's car seat cushions according to FIG. 3 placed side by side.

A second cushion 10*ax* can also be placed in the car seat 100 on the inside of the cushion 10*a*. (FIG. 8). The second cushion 10*ax* is identical to the cushion 10. The second cushion 10*ax* can also be smaller in length and thickness than the cushion 10*a*. The second cushion 10*ax* can be placed side by side next to the cushion 10*a* in the car seat 100 when the infant is very small in size, for example, when the infant is a new born or a premature infant and does not properly fit into the car seat 100. Similarly, when the infant grows to a larger size, the second cushion 10*ax* is removed from the car seat, leaving only the cushion 10*a* which increases the surface area of the car seat upon which the infant can lie.

It is to be understood that the standard cradle angle of the schematically illustrated car seat is only an approximation. If the standard cradle angle is different than the 105° illustrated herein, the pre-formed bend angle θ of the cushion 10*a* can also be modified from 105° to match approximately to the standard cradle angle without departing from the scope of the invention. For example, car seat cradle angles may vary according to manufacture in extreme cases from between 90°–135°. Therefore, the cushion 10*a* can also have a bend angle θ from between 90°–135°.

Figure 4:
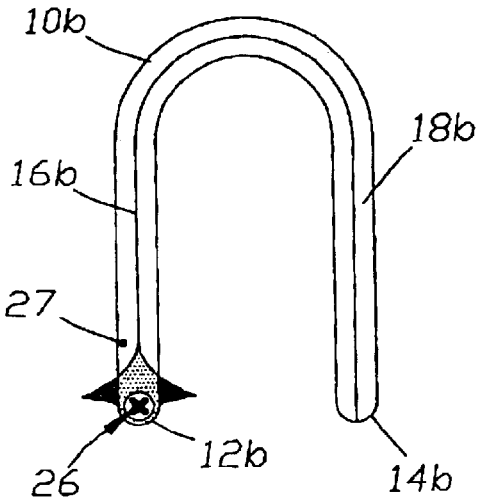
FIG. 4 is a partial cross-sectional view of a third embodiment of the child's car seat cushion according to the present invention.

FIG. 4 illustrates a third embodiment of the invention. The cushion 10*b* is similar to the cushion 10 FIGS. 1–2, and parts that are the same or similar are given the same reference numerals with the suffix "b" attached.

In this embodiment, the cushion 10*b* includes an audible sound producing device, namely a battery operated music box 26, located in the axial end 12*b* of the leg 16*b*. The music box 26 plays chime lullabies or similar music. The music box 26 is activated by a care giver manually depressing a button 27 sewn onto the outside of the material of the leg 16*b*. Optionally, the button 27 can be depressed so easily that the infant's leg can activate the music box if it kicks the button when the infant is placed into the car seat 100.

The music box 26 can also be self-activating. A self-activating music box 26 has no depressible buttons and activates instead in response to an impact force exceeding a predetermined impact force threshold, such as in response to the infant kicking the leg 16*b* of the cushion 10*b*. Alternately, the music box 26 can be located in the opposite axial end 14*b* of the other leg 18*b* or a music box may be located in each axial end of the cushion 10*b*. The music box 26 is only schematically illustrated since many different configurations of music boxes can be employed.

The music box 26 can also be activated using a remote control device (not illustrated). The remote control device advantageously enables activation of the music box 26 from a remote location a distance from the cushion 10*b*. For example, a caregiver located in another room from the music box 26, may activate the music box 26 using the remote control device if the infant seated with the cushion 10*b* is fussy or irritated in the hope that the music from the music box 26 will soothe the infant. Another example is that a caregiver can activate the music box 26 without much distraction while driving a vehicle and the infant is seated with the cushion 10*b* in the vehicle behind the caregiver.

The music box 26 is insulated by the batting or other cushioning media in the cushion 10*b* so that the infant cannot accidentally hurt his or her leg by a sudden movement into the cushion into area where the music box is located. On the other hand, the music box 26 is loud enough to be heard by the infant through the insulation. Preferably, the axial end 12*b* of the leg 16*b* can be opened to remove the music box 26 in order to change batteries or to wash the cushion 10*b*.

The opening in the axial end 12*b* is releasably closed by, for example, a zipper, snaps, buttons or a Velcro™ type hook-and-eye closure. Alternatively, the music box 26 can also be permanently fixed inside the cushion 10*b* in that the cushion has no opening. The music box 26 can also have a waterproof structure.

Figure 5:
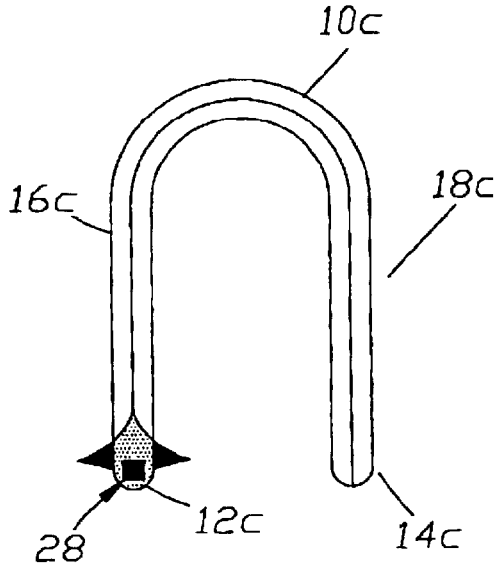
FIG. 5 is a partial cross-sectional view of a fourth embodiment of the child's car seat cushion according to the present invention.

FIG. 5 illustrates a fourth embodiment of the invention. The cushion 10*c* is similar to the cushion 10 FIGS. 1–2, and parts that are the same or similar are given the same reference numerals with the suffix "c" attached. In this embodiment, instead of the music box 26, the cushion 10*c* includes a rattle 28. The rattle 28 is located in the axial end 12*c* of the leg 16*c* of the cushion 10*c*. Alternatively, the rattle 28 may be located in the opposite axial end 14*c* of the leg 18*c* or a rattle may be located in each axial end of the cushion 10*c*. The rattle 28 is only schematically illustrated as many different configurations of rattles may be employed.

The rattle 28 is a waterproof plastic structure containing small beads which make an audible rattling sound when shaken or suddenly jarred such as when the leg of the infant kicks the cushion 10*c* where the rattle is located. Like the music box 26, the rattle 28 is also insulated by the batting or other cushioning media to prevent injury to the infant upon the infant suddenly kicking the cushion 10*c*. On the other hand, the rattle 28 is loud enough to be heard by the infant through the insulation.

Figure 6:
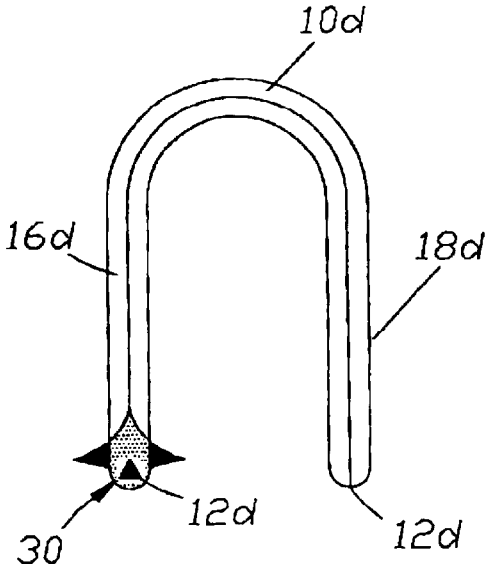
FIG. 6 is a partial cross-sectional view of a fifth embodiment of the child's car seat cushion according to the present invention.

FIG. 6 illustrates a fifth embodiment of the invention. The cushion 10*d* is similar to the cushion 10 FIG. 1-2, and parts that are the same or similar are given the same reference numerals with the suffix "d" attached. In this embodiment, instead of the music box 26 or rattle 28, the cushion 10*d* includes jingle bells 30 which are only schematically illustrated in FIG. 6.

The jingle bells 30 make an audible jingling sound when moved. The jingle bells 30 are located in the leg of the cushion in a waterproof plastic container or other container. The waterproof container permits washing of the cushion 10*d* without water contacting the jingle bells 30 to prevent the jingle bells from rusting. The jingle bells 30 can each be located in either or both axial ends of the cushion 10*d*.

The cushion 10 (FIG. 1) advantageously reduces the space available on the seat surface 110 and back surface 120 of the car seat 100 for placement of an infant. The cushion 10 prevents slouching or slumping over of an infant and helps to better secure the infant in the case of a vehicle crash event than the car seat 100 by itself without the cushion. Also, as illustrated in FIG. 10, if the second cushion 10*x* is inserted side by side next to the first cushion 10 into the car seat 100, the seat surface 110 and back surface 120 of the cushion is advantageously reduced even more to accommodate a smaller size infant.

Although the cushion 10 is shown for insertion into a car seat 100 in FIGS. 1–11, the infant cushion can be advantageously inserted horizontally in a crib (not shown) to provide a secure cushioned surrounding in which the infant cannot roll out of the confines of the cushion and into the crib slots. Instead of a crib, the infant cushion 10 can also be placed onto a bassinet, the floor, a baby swing, on top of an adult bed, into a stroller or baby buggy (not shown).

Figure 12:
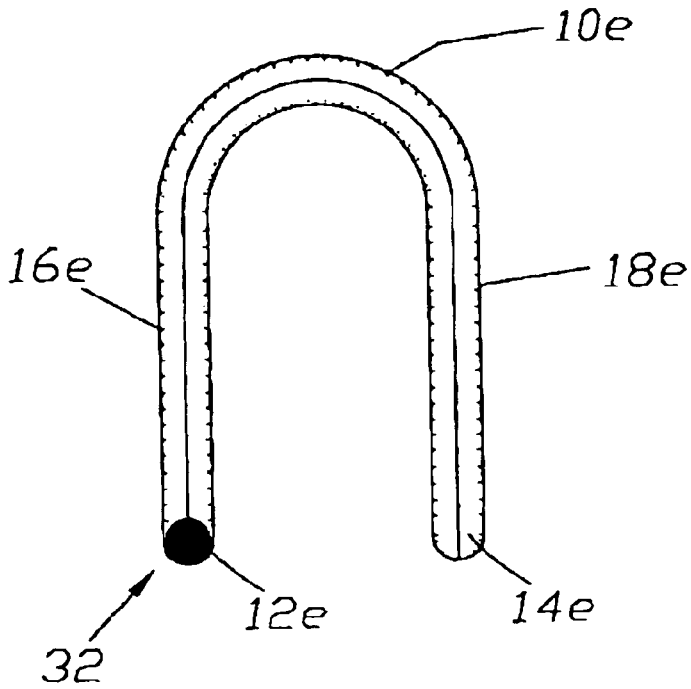
FIG. 12 is a schematic illustration of a sixth embodiment of the child's car seat cushion according to the present invention.

FIG. 12 illustrates a sixth embodiment of the invention. The cushion 10*e* is similar to the cushion 10 FIG. 1-2, and parts that are the same or similar are given the same reference numerals with the suffix "e" attached.

The cushion 10*e* includes a stuffed animal 32 located in the axial end 12*e* of the leg 16*e*. Alternatively, the stuffed animal 32 may be located on the opposite axial end 14*e* of the leg 18*e* or a stuffed animal 32 may be located on each axial end of legs 16*e* and 18*e* respectively. The stuffed animal 32 may be sewn on to the cushion 10*e* or may be attached by other fasteners such as a button, snap connection, VELCRO™ or any other suitable fastener. The stuffed animal 32 may be permanently attached to the cushion 10*e* or may be detachable.

The stuffed animal 32 is only schematically illustrated as many different configurations of stuffed animals may be employed in the embodiment of FIG. 12. The stuffed animal 32 may be any suitable configuration including, but not limited to, the face of a panda bear or a webbed foot of a duck for example. Other examples include the wings of a butterfly or bird, a whale or fish, a dog, a cat or any other animal. Numerous configurations of the stuffed animal 32 are contemplated which are intended to be within the spirit and scope of the present invention.

Figure 13:
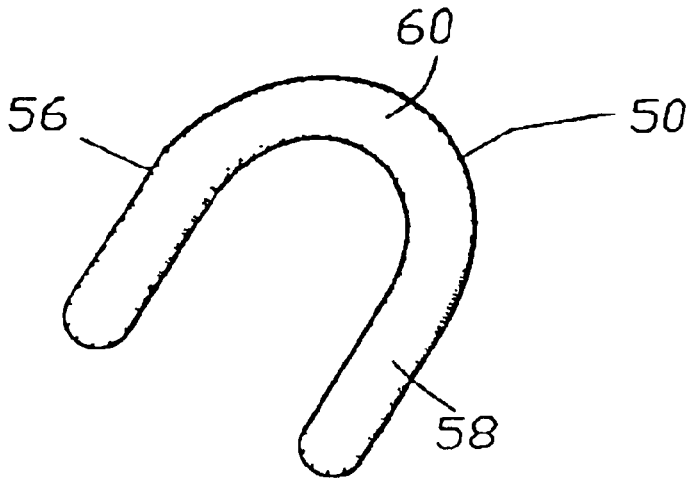
FIG. 13 is a schematic illustration of a seventh embodiment of the child's car seat cushion according to the present invention.

FIG. 13 is a schematic illustration of a seventh embodiment of the child's car s eat cushion 50 according to the present invention. The cushion 50 is similar to the cushion 10 except that cushion 50 is smaller in size. The cushion 50 has a length which is approximately one-third the length of cushion 10. The cushion 50 also has a smaller thickness or diameter compared to the cushion 10.

The cushion 50 is made from the same materials as the cushion 10 and has the same overall construction. The cushion 50 has the same flexibility as cushion 10 and can be moved from a linear shape (similar to cushion 10 illustrated in FIG. 9) to an upside down U-shape for insertion into a car'seat. Alternatively, cushion 50 can also be manufactured as a preformed U-shaped structure.

Figure 14:
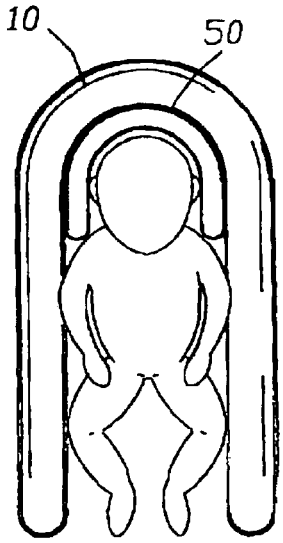
FIG. 14 is a schematic illustration of an infant with two child's car seat cushions according to the present invention including the cushion of FIG. 13.

The upside down U-shaped cushion 50 has two legs 56, 58 extending an approximately equal distance. The two legs 56, 58 extend from a base portion 60 where the two legs are joined together. The cushion 50 is intended to be placed into a car seat between the cushion 10 and the infant. FIG. 14 is a schematic illustration of an infant with a cushion 10 and a cushion 50 according to the present invention.

The head of a smaller size infant may be spaced apart from the cushion 10 while the infant is seated in the car seat. The extra space may allow the infant's head to slouch deeply to one side which may negatively affect breathing. The extra space may also allow the infant's head to flop back and forth from side to side. The head of the infant engages the cushion 50 to support the head. The cushion 50 occupies the extra space around the infant's head to prevent the head from slouching and flopping.

Figure 15:
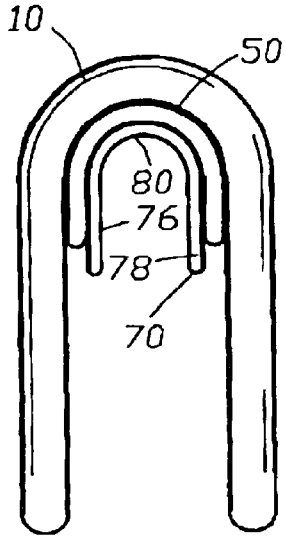
FIG. 15 is a schematic illustration of three child's car seat cushions according to the present invention including an eighth embodiment of a child's car seat cushion.

FIG. 15 is a schematic illustration of three child's car seat cushions according to the present invention including an eighth embodiment of a child's car seat cushion 70. The cushion 70 is similar to the cushion 50 except that the cushion 70 is longer in length and is smaller in diameter than the cushion 50. The cushion 70 is flexible and can be moved from a linear shape similar to cushion 50 to an upside down U-shape for insertion into a car'seat. Alternatively, cushion 70 can also be manufactured as a preformed U-shaped structure. The cushion 70 has two legs extending an approximately equal distance. The two legs 76,78 extend from a base portion 80 where the two legs are joined together.

Figure 16:
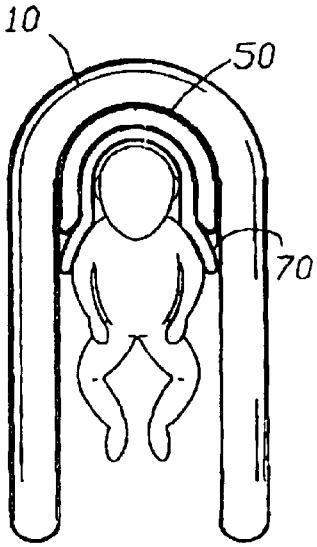
FIG. 16 is a schematic illustration of an infant positioned with the three child's car seat cushions of FIG. 15.

FIG. 16 is a schematic illustration of an infant positioned with the three child's car seat cushions 10, 50 and 70 respectively, of FIG. 15. The upside down U-shaped cushion 70 is intended to be placed into a car seat between the cushion 50 and a premature infant. The head of the premature infant may be spaced apart from the cushion 10 and cushion 50 which may result in the head slouching or flopping back and forth from side to side. The cushion 70 occupies the empty space around the premature infant's head so that the head engages the cushion 70 to help prevent the head from flopping back and forth and slouching.

The shoulders and sides of the infant's body may also be spaced apart from the cushion 10. The lack of side support and shoulder support may cause the infant to slouch or slump over. The cushion 70 is longer than cushion 50 so that cushion 70 extends down past the shoulders of the infant and approximately to the elbows. The cushion 70 is slightly deformed by the infant to hug the shoulders of the infant. Thus, the cushion 70 provides shoulder and side support for the premature infant and supports and secures the infant to help prevent slouching and slumping of the infant's body as well as the infant's head.

Figure 17:
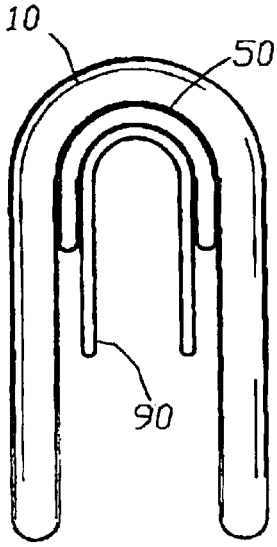
FIG. 17 is a schematic illustration of three child's car seat cushions according to the present invention including a ninth embodiment of a child's car seat cushion.

FIG. 17 is a schematic illustration of three child's car seat cushions according to the present invention including a ninth embodiment of a child's car seat cushion. The cushion 90 is similar to the cushion 70 except that the cushion 90 is longer in length.

Figure 18:
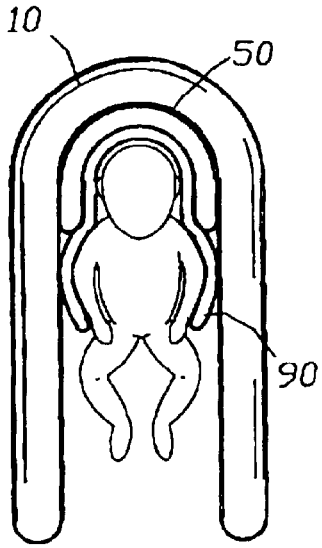
FIG. 18 is a schematic illustration of an infant positioned with the three child's car seat cushions of FIG. 17.

FIG. 18 is a schematic illustration of an infant positioned with the three child's car seat cushions of FIG. 17. The cushion 90 is longer than cushion 70 so that cushion 90 extends down past the shoulders of the infant and approximately to the hips. The cushion 90 is slightly deformed by the infant to hug he shoulders of the infant as well as the sides of the infant until approximately the hips. Thus, the cushion 90 provides shoulder and side support for the premature infant and supports and secures the body of the infant as well as the head of the infant to help prevent slouching and slumping of the infant.

The infant's arms may be positioned to the side of either the cushion 70 and the cushion 90 or above the cushion 70 and the cushion 90 and the cushions 70, 90 will still provide excellent support to the head and side of the premature infant's body.

Figure 19:
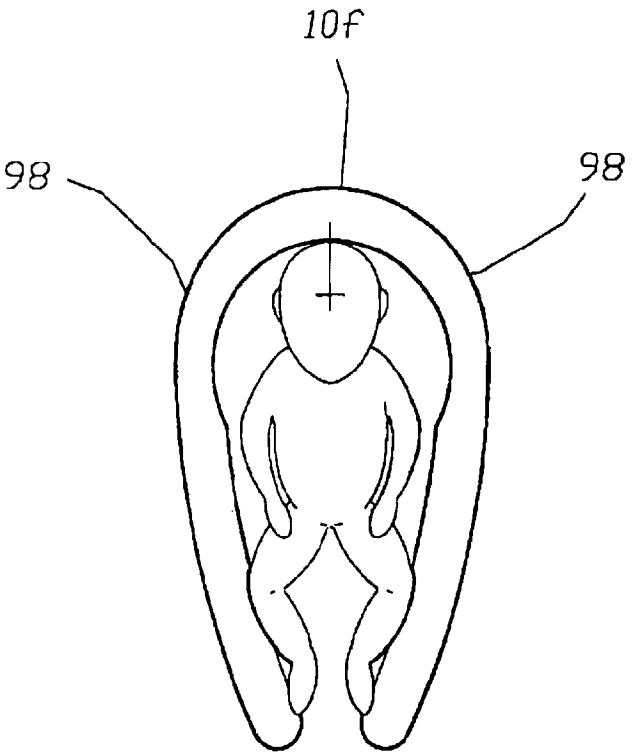
FIG. 19 is a schematic illustration of an infant positioned with the cushion according to a tenth embodiment of the present invention.

FIG. 19 illustrates a tenth embodiment of the invention. The cushion 10*f* is similar to the cushion 10 FIG. 1-2, and parts that are the same or similar are given the same reference numerals with the suffix "f" attached.

Figure 20:
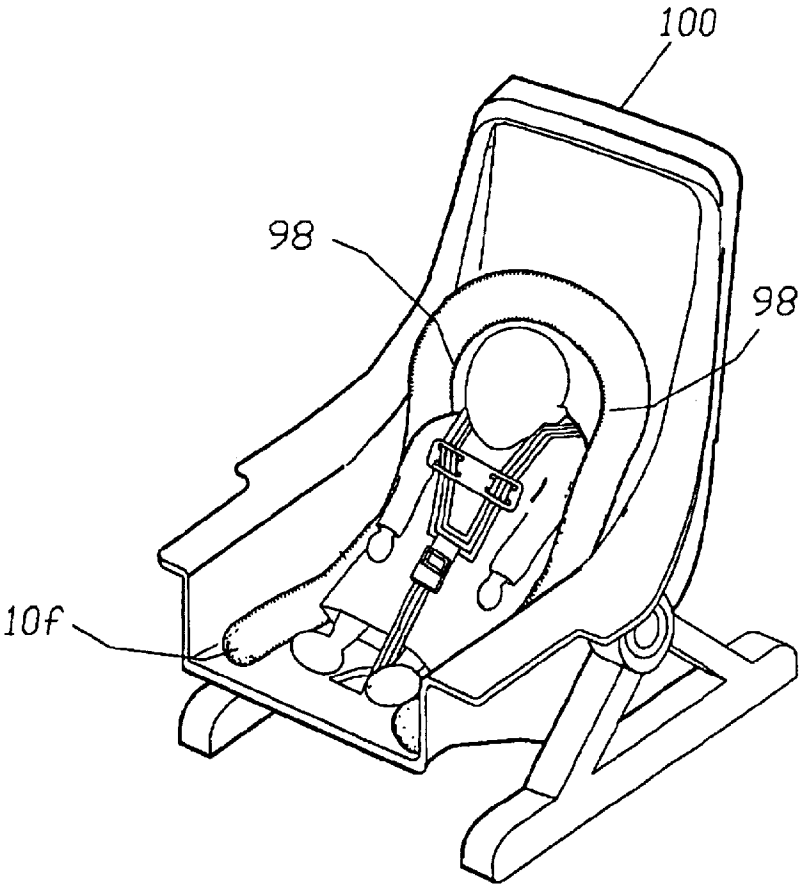
FIG. 20 is a schematic illustration of an infant positioned in a car seat with the cushion of FIG. 19.

The cushion 10*f* includes a portion 98 of each leg which is reduced in thickness/diameter relative to the thickness/diameter of the remainder of the cushion 10*f*. The reduced thickness portions 98 of the cushion 10*f* are located relative to the child along a distance approximately between the child's temples and chin. The reduced thickness portions 98 allow for a larger empty space between the child's temples and chin and the cushion 10*f* in order to help the child to breathe easier if, for example, the child turns its head in the left or right directions. The top of the child's head is in contact with the base of the cushion to provide support to the child's head to help the child's head to face in a forward direction. Similar to the cushion 10, cushion 10*f* contact the entire lateral sides of the infant and conforms to the shape of the infant. FIG. 20 illustrates the cushion 10*f* and child shown in FIG. 19 placed into a car seat 100.

From the above description of the invention, those skilled in the art will perceive improvements, changes and modifications. For example, the infant can be placed into the car seat 100 either before the cushion 10 is placed into the car seat or after the cushion is placed into the car seat. The cushion 10 is flexible enough to allow adjustments to its position in the car seat 100 by a care giver with the infant already placed into the car seat before the cushion is placed into the car seat. Such improvements, changes and modifications within the skill of the art are intended to be covered by the appended claims.

Having described the invention, the following is claimed:

1. A cushion for helping to secure an infant in a child's car seat and to prevent slouching of the infant in the car seat, the car seat comprising a seat surface and a back surface extending between two side walls, said cushion comprising:

a unitary preformed U-shaped structure having a base portion and two legs extending equidistant from said base portion, said two legs having axial ends, when placed into the car seat, said base portion of said cushion being located at a top of the back surface and said axial ends of said legs being located at a free edge of the seat surface, and one or both of said axial ends containing an audible sound producing device, said cushion reducing the surface area for an infant to be placed in the car seat to occupy in order to help secure the infant in the car seat and to minimize slouching of the infant in the car seat, wherein the audible sound producing device is a music box which is self-activating in response to an impact force exceeding a predetermined impact force threshold.

2. A method of helping to secure an infant in a child's car seat and to prevent slouching of the infant in the car seat, the car seat comprising a seat surface and a back surface extending between two side walls, the method comprising the steps of:

placing the infant into the car seat, and placing a first cushion having a unitary tube shaped structure into the car seat, said tube-shaped structure having an upside down U-shape including two legs with two axial ends and a base portion where said two legs are joined together, said base portion being located at the top of the back surface of the car seat and the two axial ends of said legs being located at a free edge of the seat surface of the car seat, said cushion legs engaging the side walls of the car seat, placing a second cushion having a unitary tube shaped structure into the car seat next to the first cushion, wherein the tube-shaped structure of the second cushion has an upside down U-shape including two legs with two axial ends and a base portion located next to the base portion of the first cushion and the two axial ends of the legs of the second cushion being located next to the legs of the first cushion spaced from the free edge of the seat surface of the car seat, placing a third cushion having a unitary tube shaped structure into the car seat next to the second cushion, wherein the tube-shaped structure of the third cushion has an upside down U-shape including two legs with two axial ends and base portion located next to the base portion of the second cushion and the two axial ends of the legs of the third cushion being located next to the legs of the first cushion and not next to the legs of the second cushion, the infant being surrounded by and engaging the third cushion base portion and legs to reduce the surface area of the car seat for the infant to occupy in order to help minimizing slouching of the infant in the car seat, wherein the second cushion has a length which is shorter than the first cushion.

3. A method of helping to secure an infant in a child's car seat and to prevent slouching of the infant in the car seat, the car seat comprising a seat surface and a back surface extending between two side walls, the method comprising the steps of:

placing the infant into the car seat, and placing a first cushion having a unitary tube shaped structure into the car seat, said tube-shaped structure having an upside down U-shape including two legs with two axial ends and a base portion where said two legs are joined together, said base portion being located at the top of the back surface of the car seat and the two axial ends of said legs being located at a free edge of the seat surface of the car seat, said cushion legs engaging the side walls of the car seat, placing a second cushion having a unitary tube shaped structure into the car seat next to the first cushion, wherein the tube-shaped structure of the second cushion has an upside down U-shape including two legs with two axial ends and a base portion located next to the base portion of the first cushion and the two axial ends of the legs of the second cushion being located next to the legs of the first cushion spaced from the free edge of the seat surface of the car seat, placing a third cushion having a unitary tube shaped structure into the car seat next to the second cushion, wherein the tube-shaped structure of the third cushion has an upside down U-shape including two legs with two axial ends and base portion located next to the base portion of the second cushion and the two axial ends of the legs of the third cushion being located next to the legs of the first cushion and not next to the legs of the second cushion, the infant being surrounded by and engaging the third cushion base portion and legs to reduce the surface area of the car seat for the infant to occupy in order to help minimizing slouching of the infant in the car seat, wherein the third cushion has a length which is longer than the second cushion but is shorter than the first cushion.

4. The method according to claim 2, including the step of:

preceding the step of placing the first cushion into the car seat, bending the first cushion into an upside down U-shape at a location which is at approximately half of a total length of the first cushion.

5. The method according to claim 2, including the step of:

preceding the step of placing the second cushion into the car seat, bending the second cushion into an upside down U-shape at a location which is at approximately half of a total length of the second cushion.

6. A method of helping to secure an infant in a child's seat and to prevent slouching of the infant in the child's seat, the child's seat comprising a seat surface and a back surface extending between two side walls, said method comprising the steps of providing a first unitary cushion having an upside down U-shaped structure with a base portion which extends between two legs of the first cushion, providing a second unitary cushion having an upside down U-shaped structure with a base portion which extends between two legs of the second cushion, providing a third unitary cushion having an upside down U-shaped structure with a base portion which extends between two legs of the third cushion, positioning the first cushion in the child's seat, said step of positioning the first cushion in the child's seat includes positioning the base portion of the first cushion in engagement with the back surface of the child's seat, said step of positioning the first cushion in the child's seat includes positioning a first one of the legs of the first cushion along and in engagement with a first one of the side walls of the child's seat, said step of positioning the first cushion in the child's seat includes positioning a second one of the legs of the first cushion along and in engagement with a second one of the side walls of the child's seat, positioning the second cushion in the child's seat, said step of positioning the second cushion in the child's seat includes positioning the base portion of the second cushion in engagement with the base portion of the first cushion, said step of positioning the second cushion in the child's seat includes positioning a first one of the legs of the second cushion in engagement with the first one of the legs of the first cushion, said step of positioning the second cushion in the child's seat includes positioning a second one of the legs of the second cushion in engagement with the second one of the legs of the first cushion, positioning the third cushion in the child's seat, said step of positioning the third cushion in the child's seat includes positioning the base portion of the third cushion in engagement with the base portion of the second cushion, said step of positioning the third cushion in the child's seat includes positioning a first one of the legs of the third cushion in engagement with the first one of the legs of the second cushion, said step of positioning the third cushion in the child's seat includes positioning a second one of the legs of the third cushion in engagement with the second one of the legs of the second cushion and placing the infant into the child's seat with lateral sides and top of the head of the infant at least partially enclosed by the base portion of the third cushion and with hips and legs of the infant at least partially disposed between the first and second legs of the first cushion to reduce surface area of the child's seat for the infant to occupy in order to help minimizing of slouching of the infant in the child's seat.

7. A method as set forth in claim 6 wherein said step of positioning a first one of the legs of the third cushion in engagement with the first one of the legs of the second cushion includes positioning the first one of the legs of the third cushion with an axial end portion of the first one of the legs of the third cushion extending beyond an axial end of the first one of the legs of the second cushion in a direction away from the base portion of the third cushion, said step of positioning a second one of the legs of the third cushion in engagement with the second one of the legs of the second cushion includes positioning the second one of the legs of the third cushion with an axial end portion of the second one of the legs of the third cushion extending beyond an axial end of the second one of the legs of the second cushion in a direction away from the base portion f the third cushion.

8. A method as set forth in claim 6 wherein said step of placing the infant into the child's seat includes placing the infant in the child's seat with axial ends of the legs of the second cushion disposed adjacent shoulders of the infant.

9. A method as set forth in claim 8 wherein said step of placing the infant into the child's seat includes placing the infant in the child's seat with portions of the first and second legs of the third cushion disposed adjacent to upper portions of arms of the infant.

10. An apparatus comprising:

a child's seat having first and second side walls with a seat surface extending between said first and second side walls and a back surface extending between said first and second side walls, a first unitary cushion having an upside down U-shaped structure with a base portion which extends between two legs of said first cushion, said base portion of said first cushion being disposed in engagement with said back surface of said child's seat, a first one of said two legs of said first cushion extends along the first side wall of said child's seat, a second one of said two legs of said first cushion extends along the second side wall of the child's seat, a second unitary cushion having an upside down U-shaped structure with a base portion which extends between two legs of said second cushion, said base portion of said second cushion being disposed in engagement with said base portion of said first cushion, a first one of said two legs of said second cushion being disposed in engagement with said first leg of said first cushion, a second one of said two legs of said second cushion being disposed in engagement with said second leg of said first cushion, a third unitary cushion having an upside down U-shaped structure with a base portion which extends between two legs of said third cushion, said base portion f said third cushion being disposed in engagement with said base portion of said second cushion, a first one of said two legs of said third cushion being disposed in engagement with said first leg of said second cushion, a second one of said two legs of said third cushion being disposed in engagement with said second leg of said second cushion, said base portion of said third cushion being adapted to at least partially enclose lateral sides and top of a head of an infant disposed in the child's seat, said first and second legs of said first cushion being adapted to at least partially enclose hips and legs of the infant, said first, second and third cushions cooperate to reduce surface area of the child's seat for the infant to occupy to help minimize slouching of the infant in the child's seat.

11. An apparatus as set forth in claim 10 wherein said first leg of said third cushion extends beyond an axial end of said first leg of said second cushion in a direction away from said base portion of said third cushion, said second leg of said third cushion extends beyond an axial end of said second leg of said second cushion in a direction away from said base portion of said third cushion.

* * * * *